US009464859B2

(12) United States Patent
Potter et al.

(10) Patent No.: US 9,464,859 B2
(45) Date of Patent: Oct. 11, 2016

(54) BARREL EXTENSION FOR FIREARM

(71) Applicant: Sturm, Ruger & Company, Inc., Southport, CT (US)

(72) Inventors: Dwight Potter, Unity, NH (US); Benjamin Gerard Hawkins, Sunapee, NH (US); Michael Robert Tilton, Andover, NH (US)

(73) Assignee: STURM, RUGER & COMPANY, INC.

( * ) Notice: Subject to any disclaimer, the term of this patent is extended or adjusted under 35 U.S.C. 154(b) by 0 days.

(21) Appl. No.: 14/816,306

(22) Filed: Aug. 3, 2015

(65) Prior Publication Data

US 2016/0033226 A1 Feb. 4, 2016

Related U.S. Application Data

(60) Provisional application No. 62/032,228, filed on Aug. 1, 2014.

(51) Int. Cl.

| | |
|---|---|
| ***F41A 21/48*** | (2006.01) |
| ***F41A 21/12*** | (2006.01) |
| ***F41A 3/30*** | (2006.01) |

(52) U.S. Cl.

CPC ..... *F41A 21/485* (2013.01); *F41A 3/30* (2013.01); *F41A 21/12* (2013.01); *F41A 21/482* (2013.01)

(58) Field of Classification Search

CPC ..... F41A 3/26
USPC ..... 42/76.01
See application file for complete search history.

(56) References Cited

U.S. PATENT DOCUMENTS

| | | | | |
|---|---|---|---|---|
| 2,502,613 A | | 4/1950 | Zanolio | |
| 3,027,672 A | | 4/1962 | Sullivan | |
| 3,566,744 A | * | 3/1971 | Stoner | F41A 3/78 42/25 |
| 4,540,912 A | * | 9/1985 | Matesco | H01T 13/08 313/142 |
| 5,937,563 A | * | 8/1999 | Schuetz | F41A 21/10 42/106 |

(Continued)

FOREIGN PATENT DOCUMENTS

| | | | | |
|---|---|---|---|---|
| DE | 2841938 A1 | * | 4/1980 | F41A 3/58 |
| FR | 2340530 A2 | * | 9/1977 | F41A 21/28 |

OTHER PUBLICATIONS

Sporting Arms and Ammunition Manufacturers' Institute, Inc., Cartridge and Chamber Drawings 12-Gauge-2 3/4", May 29, 1979.*

(Continued)

*Primary Examiner* — Troy Chambers
*Assistant Examiner* — Joshua Semick
(74) *Attorney, Agent, or Firm* — The Belles Group, P.C.

(57) ABSTRACT

A firearm with barrel extension comprises a receiver, a barrel supported by the receiver that defines an ammunition shell chamber, and a rotatable locking bolt having radial bolt lugs. The bolt is carried by a slide disposed in the receiver for forward and rearward movement. A barrel extension is mounted on a rear end of the barrel which includes radial bolt locking lugs that rotatably engage the bolt lugs when the bolt is in a closed locked breech position in battery with the head of a chambered shell. The barrel extension includes a rear facing annular rim seating surface formed integrally on the barrel extension as a unitary structural part thereof. The rim seating surface extends radially inwards from an interior surface of the barrel extension to engage and support the rear rim of the chambered shell. The headspacing is defined entirely by the barrel extension independently of the barrel.

16 Claims, 14 Drawing Sheets

(56) References Cited

U.S. PATENT DOCUMENTS

| | | | | |
|---|---|---|---|---|
| 6,044,748 | A | 4/2000 | Westrom | |
| 6,609,319 | B1 * | 8/2003 | Olson | F41A 3/26 42/16 |
| 7,877,919 | B2 * | 2/2011 | Richards | F41A 3/22 42/51 |
| 8,079,167 | B1 * | 12/2011 | Overstreet | F41C 9/08 42/51 |
| 8,087,194 | B1 * | 1/2012 | Vuksanovich | F41A 21/48 42/75.01 |
| 8,479,429 | B2 * | 7/2013 | Barrett | F41A 3/26 42/75.02 |
| 8,490,312 | B2 * | 7/2013 | Barrett | F41A 3/26 42/75.02 |
| 8,505,227 | B2 * | 8/2013 | Barrett | F41A 3/26 42/75.02 |
| 8,539,708 | B2 * | 9/2013 | Kenney | F41A 21/485 42/75.01 |
| 8,739,450 | B2 * | 6/2014 | Piontek | F41A 21/10 42/77 |
| 9,057,576 | B2 * | 6/2015 | Barrett | F41A 21/481 |
| 2010/0269682 | A1 | 10/2010 | Vuksanovichi et al. | |
| 2015/0090105 | A1 * | 4/2015 | Pace | F41A 21/30 89/14.4 |
| 2015/0168092 | A1 * | 6/2015 | Stone | F41A 21/28 42/76.01 |
| 2015/0330730 | A1 * | 11/2015 | Stone | F41A 9/55 89/33.01 |
| 2015/0369555 | A1 * | 12/2015 | Daniel | F41A 21/48 42/75.02 |

OTHER PUBLICATIONS

Corresponding International Search Report and Written Opinion for PCT/US2015/043386 dated Oct. 26, 2015.

* cited by examiner

BARREL EXTENSION FOR FIREARM

CROSS-REFERENCE TO RELATED APPLICATIONS

The present application claims the benefit of priority to U.S. Provisional Application No. 62/032,228 filed Aug. 1, 2014, the entirety of which is incorporated herein by reference.

BACKGROUND

The present invention generally relates to firearms, and more particularly to barrel assemblies for firearms such as rifles and shotguns.

During the discharge of a firearm such as a rifle or shotgun for example, it is advantageous to have the reciprocating bolt locked into the rear of the barrel (i.e. chamber which holds the cartridge or shell) during discharge to prevent combustion gases from escaping and maintaining a closed breech. To ensure a secure lockup and proper positioning of the bolt with respect to the chamber, a parameter referred to as "headspace" is used. This terminology and its meaning are well known in the art. Essentially, headspace is the distance measured from (1) the surface of the barrel associated with the cartridge chamber that engages the cartridge or shell to set its proper insertion depth into the chamber to (2) the front breech face of the bolt that engages the rear end of the chambered cartridge or shell. Because numerous different cartridge or shell designs are available in varying calibers, the points used to measure the headspace parameter will vary depending on the type of ammunition being chambered. As an example, for rimmed cartridges or shells having a rear flange that radially protrudes beyond the outside diameter of the ammunition head, the headspace is generally measured by the axial thickness of the rim. For rimless ammunition, the headspace may be measured between the bolt breech face and the interior chamber surface that engages the shoulder (for tapered cartridges) or front of the ammunition case adjacent the bullet or slug.

In some rimmed ammunition designs, the rearmost annular end of the barrel at the chamber entrance typically defines the rim seat or seating surface that engages the rim of the chambered ammunition and establishes the datum reference line for measuring the headspace. After repeated firing of the firearm over time and loading/unloading cartridges or shells into/from the barrel chamber, this annular seating surface gradually wears especially with auto-loading firearms. This increases the headspace and gap between the rear of the cartridge or shell and the bolt breech face, thereby causing the headspace to eventually become out of "spec" creating an undesirable operating condition. When this occurs, the entire barrel must typically be discarded and replaced in some designs to restore the proper headspace dimension for ensuring that the rear of the cartridge or shell is properly supported during firing to withstand the combustion pressures generated and prevent rupture of the ammunition case.

An improved design is desired.

SUMMARY

A replaceable barrel extension in certain non-limiting embodiments of the present invention includes an integral cartridge or shell rim seating surface. The barrel extension is configured for detachable coupling to the rear end of the barrel adjacent the entrance to the chamber. Rather than discarding the entire barrel with rifled bore and sights, only replacement of the barrel extension with integral cartridge or shell rim seating surface is needed to restore the proper headspace to the firearm. Advantageously, the barrel extension can be replaced at considerably less expense and inconvenience to the user. In one embodiment, the barrel extension may be threadably attached to the rear end of the barrel. Various embodiments of a barrel extension may further include bolt locking lugs configured and arranged to engage bolt lugs on the head of the bolt for forming a locked closed breech.

An additional benefit gained in the present invention relates to the ease of manufacturing. By containing all the surfaces in the barrel assembly that relate to headspace in one part, the barrel extension, the tolerance for the headspace can be better maintained. In the prior methods of assembly, the barrel contained the forward surface for measuring the head space and the barrel extension contained the rearward surface. This induced a tolerance stack up as the two parts were assembled. In the present invention, both the rearward surface and the forward surface are contained in one part eliminating the assembly tolerance stack up.

An additional advantage of the present invention is that by including in the barrel extension the portion of the barrel and chamber which contains the cut out for the extractor, the barrel end can be cut totally as a turned part. The clearance for the extractor can be machined in the barrel extension along with its other features. This eliminates a cut in the barrel that would require alignment to the barrel extension. The prior ways of making the barrel and barrel extension assembly was to either assemble the two parts together as an assembly and then machine the extractor clearance cut, or alternatively to assemble, then mark the location of the cut, disassemble, cut, and then reassemble. The present invention therefore eliminates these prior more complex and cumbersome fabrication processes, thereby reducing manufacturing time and expense.

In one aspect, a firearm with barrel extension includes a longitudinal axis; a receiver; a barrel supported by the receiver and including a front muzzle end, a rear breech end defining a chamber for holding an ammunition shell, and an axial bore extending between the ends; a bolt supported by the receiver for axial forward and rearward movement, the bolt comprising a bolt head including a plurality of bolt lugs extending radially outward from the bolt and rotatable between locked and unlocked breech positions; a tubular barrel extension having a front end coupled to the rear breech end of the barrel and a rear end defining a plurality of bolt locking lugs that rotatably engage the bolt lugs when the bolt is in the locked breech position; and a rear facing annular rim seating surface formed integrally on the barrel extension as a unitary structural part thereof, the rim seating surface extending radially inwards from an interior surface of the barrel extension and arranged to engage a rim of a shell when positioned in the chamber.

In another aspect, a firearm with barrel extension includes a receiver; a barrel supported by the receiver and including a front muzzle end, a rear breech end defining a chamber configured to hold an ammunition shell, and an axial bore extending between the ends that defines a longitudinal axis; a slide movably disposed in the receiver for axial forward and rearward movement; a bolt supported by the slide and axially movable forward and rearward with the slide, the bolt comprising a bolt head including a plurality of bolt lugs extending radially outward from the bolt and rotatable between locked and unlocked breech positions; a tubular barrel extension having a front mounting portion coupled to the rear breech end of the barrel and a rear locking portion defining a plurality of bolt locking lugs that rotatably engage the bolt lugs when the bolt is in the locked breech position; and a rear facing annular rim seating surface formed integrally on the barrel extension as a unitary structural part thereof, the rim seating surface extending radially inwards from an interior surface of the barrel extension; wherein when a shell having a case and a rear rim is loaded in the chamber in a forward-most position, the case engages the chamber in the barrel and rim engages the rim seating surface of the shell.

A barrel extension for a firearm with lockable breech includes: a tubular body including an axial centerline, a front mounting portion configured for coupling to a rear breech end of a firearm barrel, and a rear locking portion, the barrel extension including circumferential sidewalls extending longitudinally between the mounting and locking portions that defines an internal axial cavity; a plurality of inwardly extending radial bolt locking lugs in the rear locking portion; a plurality of axial channels disposed between the bolt locking lugs which extend forward from a rear end of the barrel extension into a circumferential groove located in front of the bolt locking lugs, wherein the bolt locking lugs are configured to rotatably engage radial bolt lugs of a lockable bolt of the firearm when the bolt lugs are positioned in the circumferential groove and rotated; and a rear facing annular rim seating surface formed integrally on the barrel extension as a unitary structural part thereof, the rim seating surface extending radially inwards from the sidewalls in the axial cavity and positioned to engage a radially protruding rim of an ammunition shell when inserted into the barrel extension from the rear end.

BRIEF DESCRIPTION OF THE DRAWINGS

The features of the exemplary embodiments will be described with reference to the following drawings where like elements are labeled similarly, and in which:

All drawings are schematic and not necessarily to scale. Parts shown and/or given a reference numerical designation in one figure may be considered to be the same parts where they appear in other figures without a numerical designation for brevity unless specifically labeled with a different part number and described herein. References herein to a figure number (e.g. FIG. 1) shall be construed to be a reference to all subpart figures in the group (e.g. FIGS. 1A, 1B, etc.) unless otherwise indicated.

DETAILED DESCRIPTION

Figure 1:
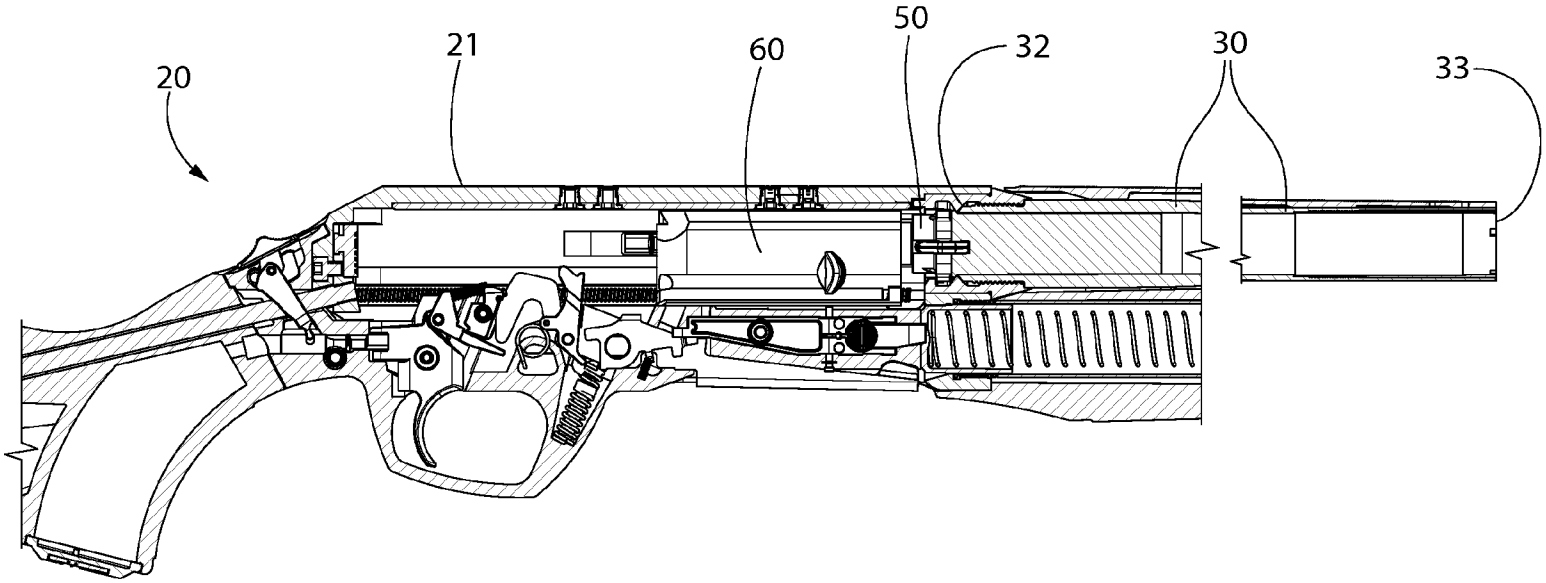
FIG. 1 is a partial cross-sectional right side view of a firearm having a barrel extension according to the present disclosure.

The features and benefits of the invention are illustrated and described herein by reference to exemplary embodiments. This description of exemplary embodiments is intended to be read in connection with the accompanying drawings, which are to be considered part of the entire written description. Accordingly, the disclosure expressly should not be limited to such exemplary embodiments illustrating some possible non-limiting combination of features that may exist alone or in other combinations of features.

In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

The terms "shell" and "cartridge" may used interchangeably herein in reference to describing ammunition, and therefore are not to be construed as limiting the invention or the claims appended hereto. For convenience and brevity, further description of ammunition which follows will use the non-limiting term of "shell."

A barrel extension according to a non-limiting embodiment of the present invention will now be described with reference to a firearm in the form of a shotgun. However, it will be appreciated that this does not limit the scope or applicability of the invention. The barrel extension may therefore be used with other long guns such as rifles or other types of firearms.

FIGS. 1-4 are longitudinal side cross sectional views of the action portion of a shotgun 20 including a barrel extension 70 according to an embodiment of the present disclosure. The shotgun includes a receiver 21, a barrel 30 fixedly coupled to the receiver and defining a longitudinal axis LA and corresponding axial direction coinciding with the centerline of the barrel bore 31, and a barrel extension 70 mounted on an open rear breech end 32 of the barrel opposite the forwardly open muzzle end 33. A chamber 34 is formed in the rear portion of the barrel which is configured to hold an ammunition shell 22. The chamber is accessible through the open rear breech end 32 of the barrel 30 for loading shells into the chamber for firing. The barrel bore 31 forms an axial pathway in communication with the chamber 34 for passing a bullet, slug, or shot. The bore 31 extends longitudinally from the breech end 32 to the muzzle end 33 of the barrel. The bore may be smooth or rifled.

The firing control system includes a trigger assembly including a trigger 24 movably mounted in the shotgun frame 25. The trigger 24 is mechanically linked or coupled to a pivotably mounted hammer 26 which is movable between cocked and uncocked positions. Cycling the action (automatically or manually) cocks the hammer rearward into the ready-to-fire position. Pulling the trigger uncocks and releases the hammer to strike the rear end of an axially movable spring-loaded firing pin 27 that is driven forward to strike a chambered shell in a well-known manner (see also FIG. 15).

The term "action" is used herein in its conventional sense in the firearm art as meaning the mechanism that loads and ejects shells into/from the firearm and opens and closes the breech (i.e. the area in the receiver between an openable/closeable breech face on the front of the bolt and the barrel chamber).

The shotgun 20 may further include a tubular magazine 40 that holds a plurality of horizontally stacked shells. The magazine includes a shell follower 41 and magazine spring 42 which biases the shells toward an open rear of the magazine for loading into the shotgun by the action. In other embodiments, a conventional removable box style magazine (not shown) may be provided in lieu of the tubular magazine. Such box magazines well known in the art hold a spring-biased vertical stack of shells and attach to the underside of the receiver in the area between the trigger and barrel chamber to upload shells into an open breech. The invention is not limited by either type of magazine which may be used with a barrel extension according to the present disclosure.

With continuing reference to FIGS. 1-4, a pivotable carrier 43 is positioned behind the tubular magazine 40 that receives and uploads a shell 22 from the magazine into the breech for chambering by the bolt 50. A carrier latch 44 and shell stop 45 may be provided that respectively control the uploading of shells to the breech and dispensing of shells from the magazine so that only a single shell is dispensed to the carrier 43 at a time during the firing and reloading cycle. Such arrangements and operation are well known in the art.

Figure 2:
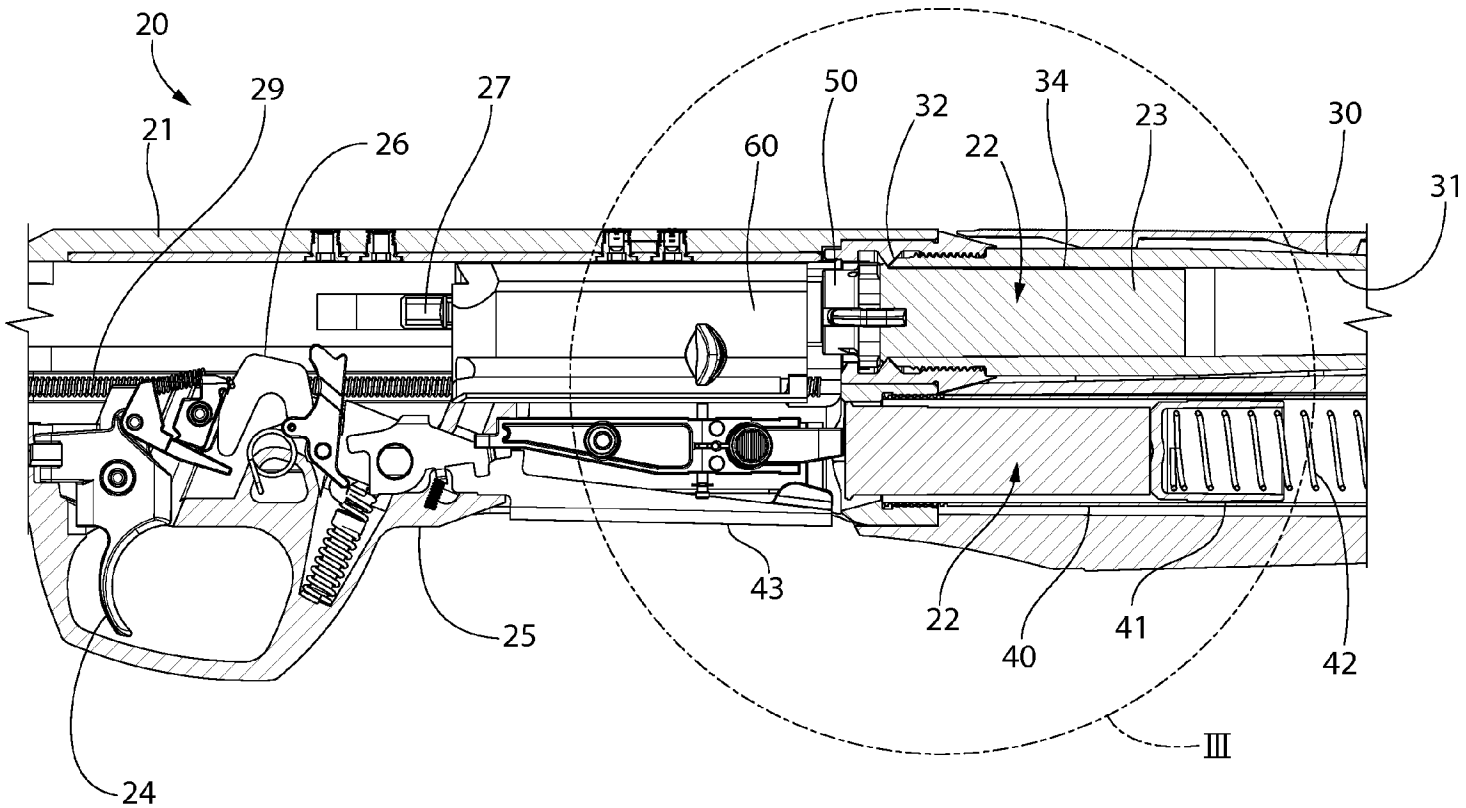
FIG. 2 is an enlarged view thereof.
Figure 3:
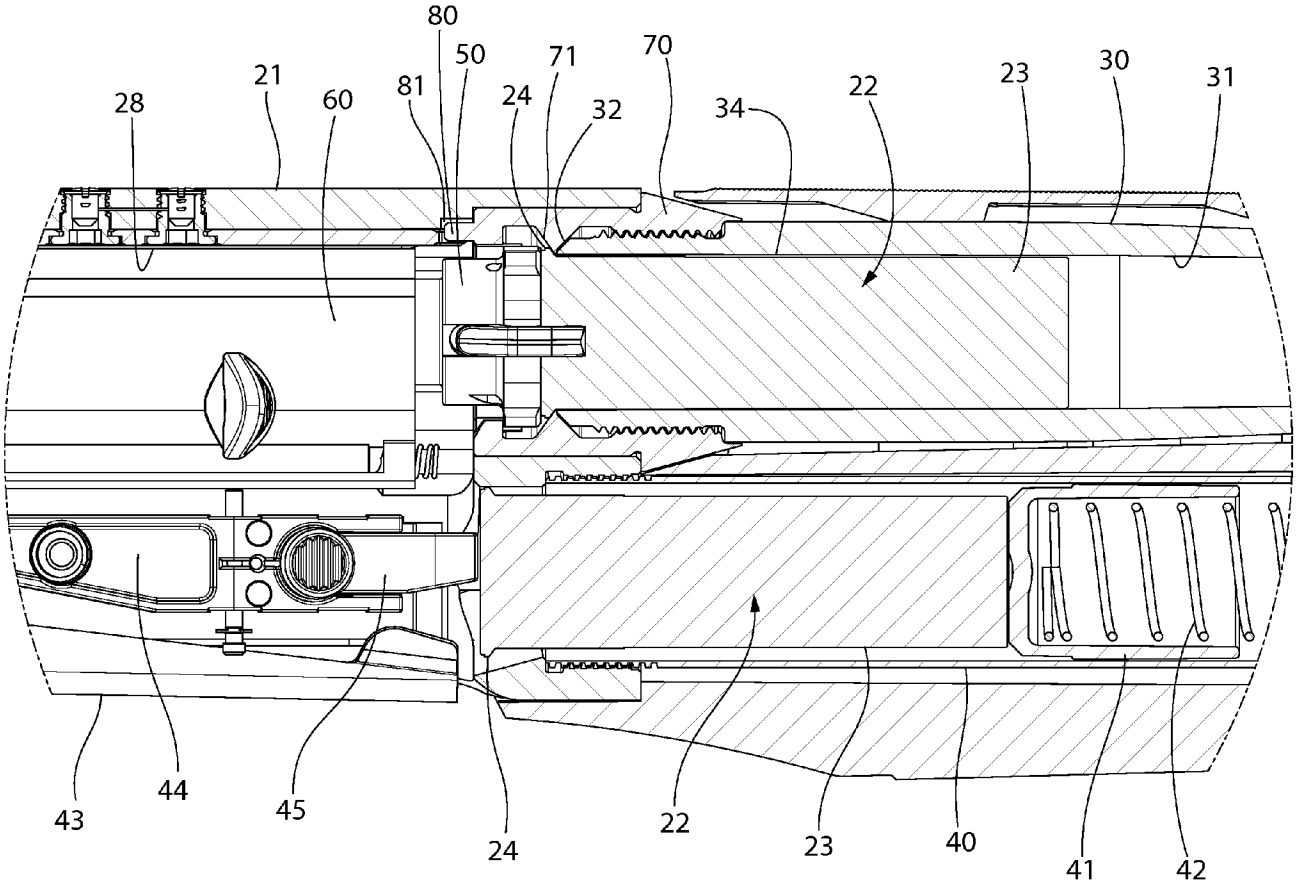
FIG. 3 is an enlarged detail from FIG. 2 showing a closed breech with bolt in battery with the rear head of a fully chambered shell in a forward-most position.
Figure 15:
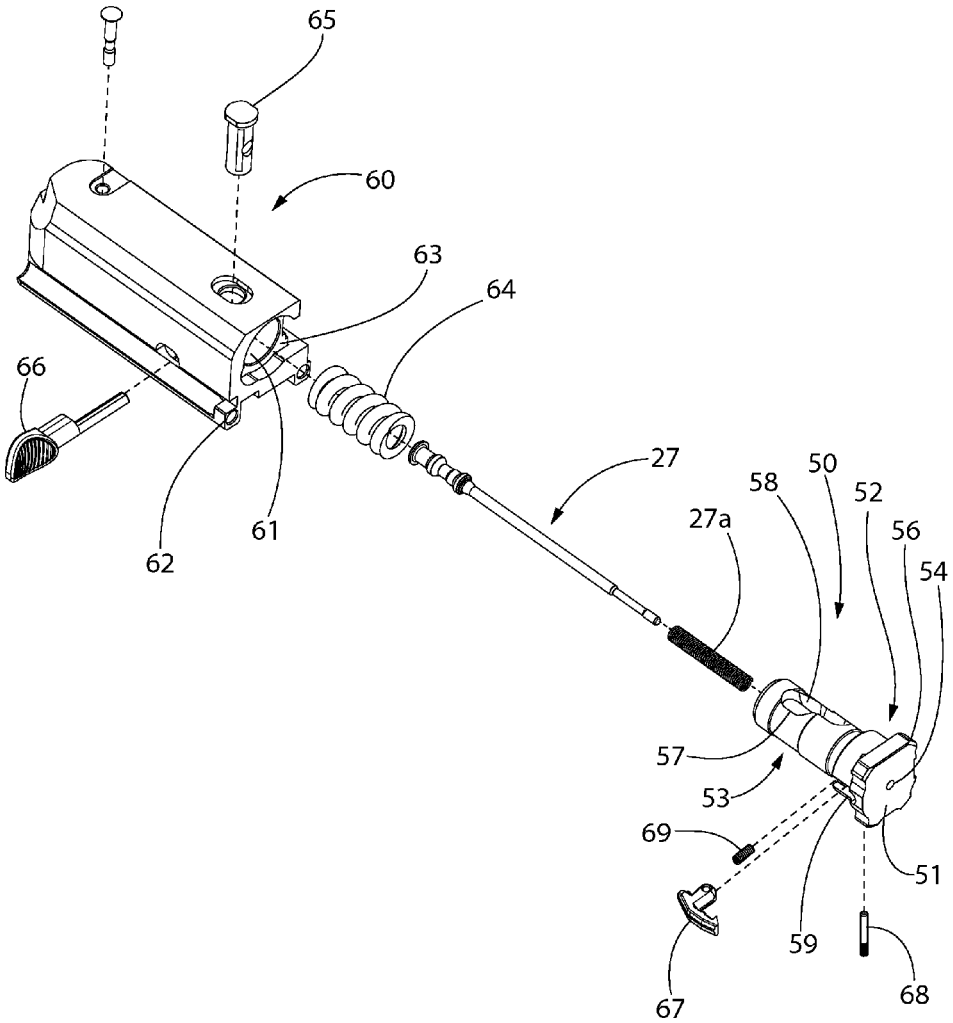
FIG. 15 is an exploded perspective view of the slide and bolt assembly with related components.

The shotgun 20 and its action further include a reciprocating bolt slide 60 (referred to herein as "slide" for short) and a bolt 50 operably carried by and coupled to the slide (see also FIG. 15). The slide is movably axially in reciprocating rearward and forward motions to open and close the breech (action). The slide 60 is disposed in an open interior elongated compartment 28 within the receiver 21 and may travel along a track formed in the compartment to smoothly guide the slide. The bolt 50 is carried by the front portion of the slide which is at least partially hollow and projects axially forward from the slide. The bolt has a forward facing surface that defines a breech face 51 which functions to form a closed or open breech in cooperation with the barrel chamber 34 in a well-known manner. FIG. 1-3 show a closed breech with the breech face 51 supporting the rear and rim 24 area of the shell 22 for firing. The slide 60 and bolt 50 are coaxially aligned with the barrel 30 and longitudinal axis LA of the shotgun. The slide 60 is axially movable between a forward closed breech position (shown in FIGS. 1-3) and rearward open breech position (shown in FIG. 4) spaced farther rearward from the chamber 34 to provide an axial gap for extracting and ejecting a fired or spent shell 22 from the shotgun 20, and loading a new fresh shell into the chamber.

One or more recoil springs 29 may be provided which bias the slide in a forward direction towards the barrel 30 and chamber 34 (see, e.g. FIGS. 1-4). The spring(s) 29 are compressed during recoil when the slide 60 moves rearward to the open breech position upon discharging the shotgun, and then expand to return the slide forward to the closed breech position automatically. In the present embodiment, two recoil springs are provided whose compression and expansion are guided during movement of the slide by guide rods 29*a* around which the springs are mounted. The guide rods 29*a* may be received through rings 62 formed on the slide to control movement of the slide 60 during recoil. In one embodiment, the springs may be helical compression springs. Use of other types of springs is possible.

Referring to FIGS. 6A-C and 15, the bolt 50 has an axially elongated body including a bolt head 52 disposed outside of the slide and a smaller diameter stem 53 projecting rearward from the bolt head. The stem 53 is disposed at least partially inside the slide within a cylindrically shaped passage 61. The passage is axially elongated and may have a greater length than its circular cross sectional diameter. The stem 53 is axially movable in the passage 61 with respect to the slide during cycling of the action. The entire bolt 50 is axially movable with respect to the slide 60 between a projected position and a retracted position. In the projected position, the stem extends farther outward and forward from the slide and cavity forming an axial gap between the vertical front surface of the slide and the vertical rear stopping surface 55 of the bolt head. In the retracted position, this gap is essentially eliminated during recoil when the shotgun is fired.

The bolt head 52 is generally cylindrical structure having a larger diameter than the diameter of the stem 53 or the slide cavity into which the stem projects from the bolt head. The breech face 51 is formed on the forward facing flat surface of the bolt head. The bolt head 52 includes an axial central passageway 54 which penetrates the breech face and has a circular cross section. The passageway continues rearward through the stem 53 and may become diametrically enlarged moving rearward to form a pocket for holding the firing pin 27 slideably disposed therein. The firing pin is movable in an axial direction in relation to and through the bolt 50 and breech face 51 for striking and detonating a chambered shell 22 when the breech face is closed (shown for example in FIG. 3). The pivotable hammer 26 moves between the rear cocked and forward uncocked position when released by the trigger mechanism to strike the rear of the firing pin 27, which is driven forward to contact the head of the shell. Such operation is well-known in the art.

The rear stopping surface 55 of the bolt head 52 is annular shaped (in the transverse direction) and surrounds the stem 53 which projects rearward. The rear stopping surface is rearward facing and arranged to abuttingly contact a forward facing front stopping surface 63 on the slide 60 (see also FIG. 15) under recoil when the shotgun is fired. In one embodiment, the front stopping surface 63 of the slide may be formed inside a frontal recess which opens forward and has a diameter selected to allow the rear stopping surface 55 of the bolt head to enter, thereby allowing the two blocking surfaces 55, 63 to engage and arrest the rearward motion of the bolt 50 under recoil. According, the rear portion of the bolt head 52 adjacent the blocking surface 55 partially enters the front of the slide in the frontal recess.

Figure 6A:
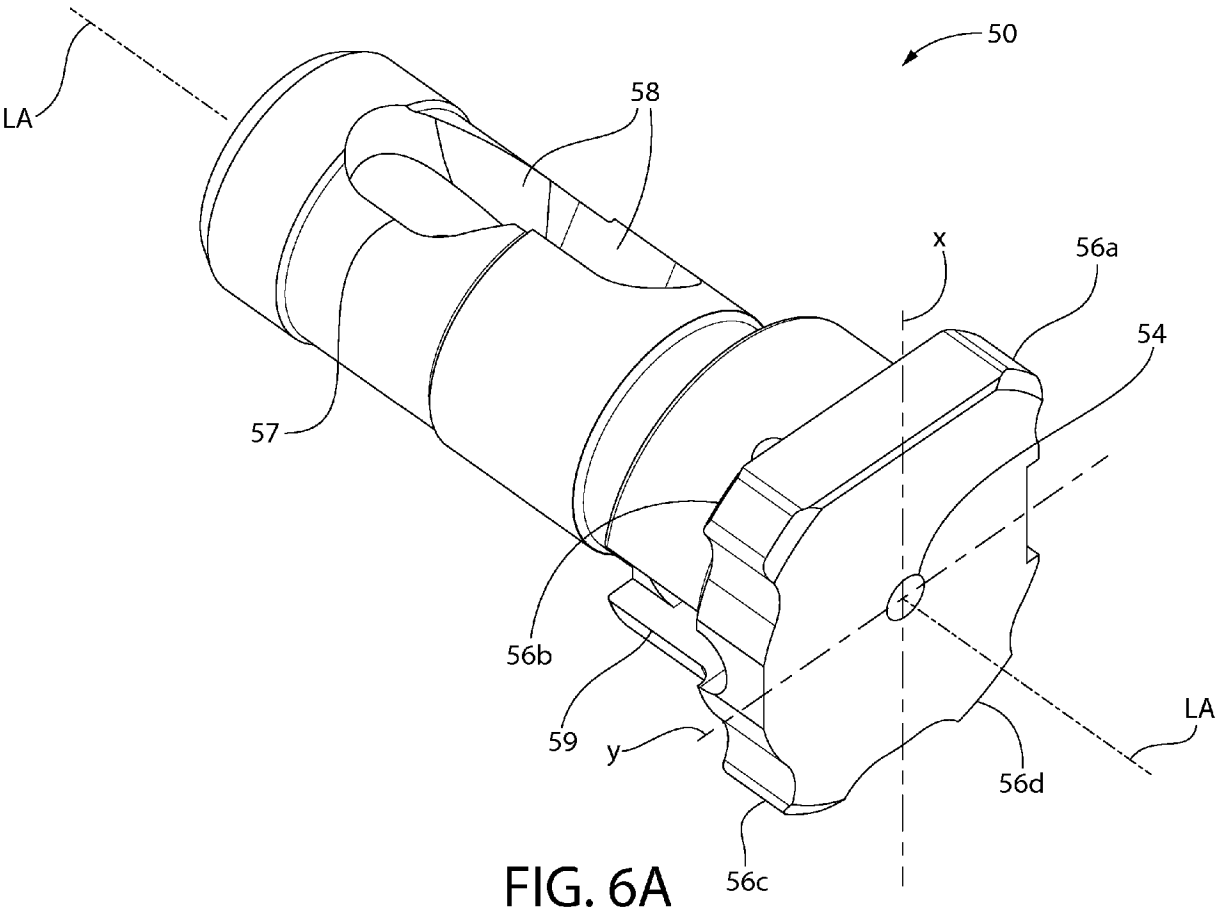
FIG. 6A is a front perspective view of the bolt.
Figure 6B:
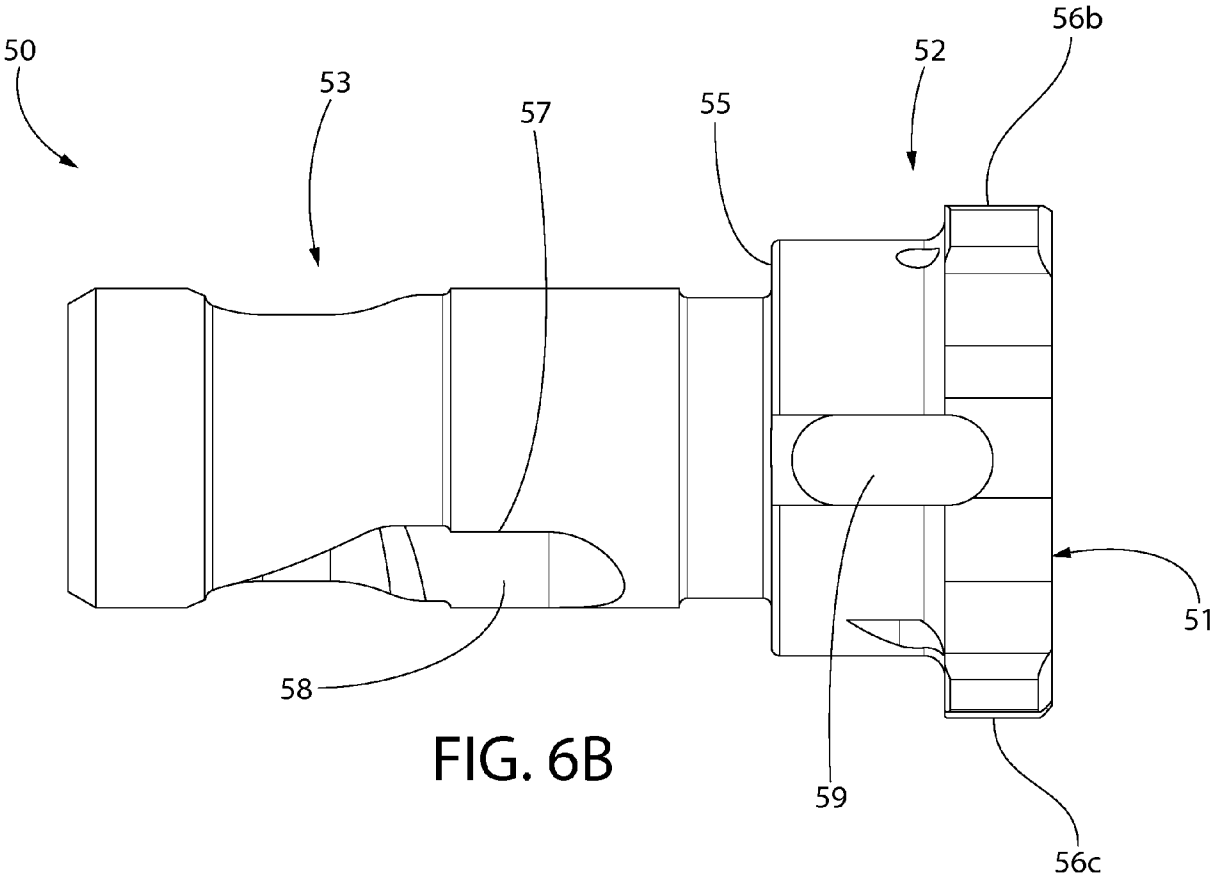
FIG. 6B is right side view thereof.
Figure 6C:
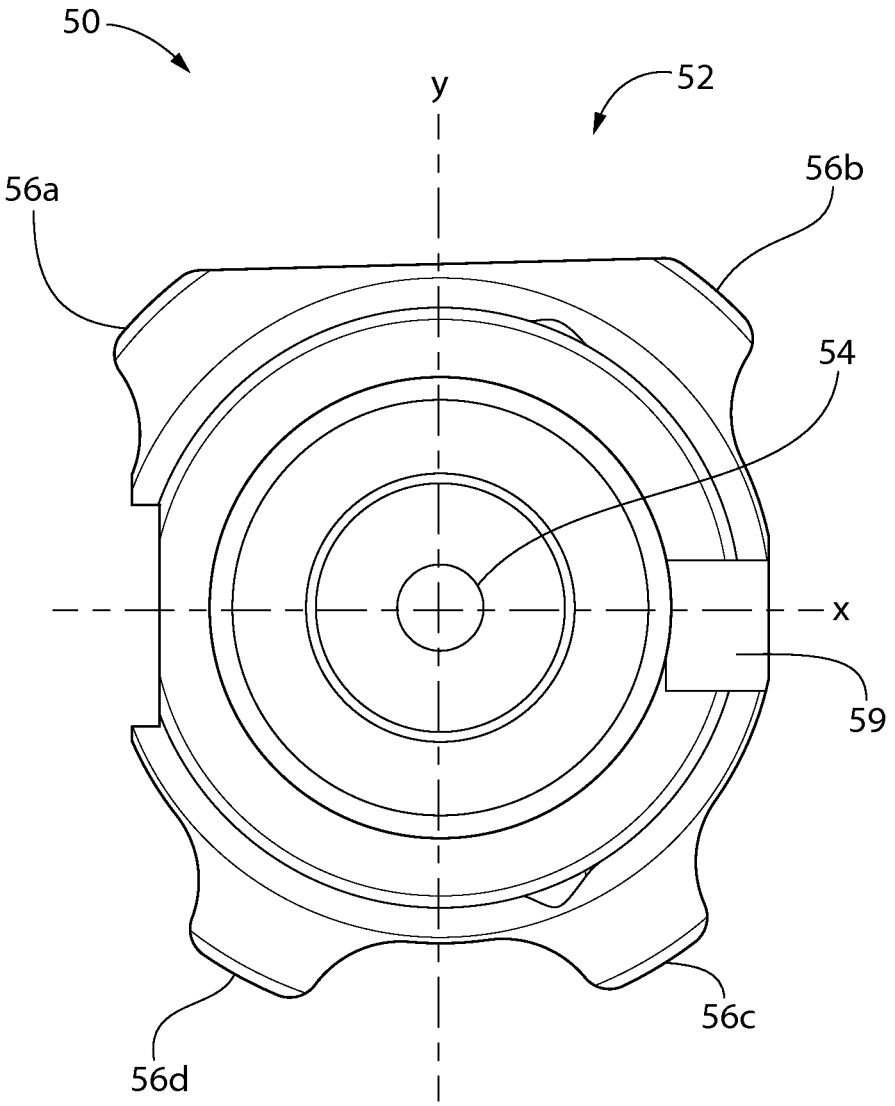
FIG. 6C is a rear end view thereof.
Figure 13:
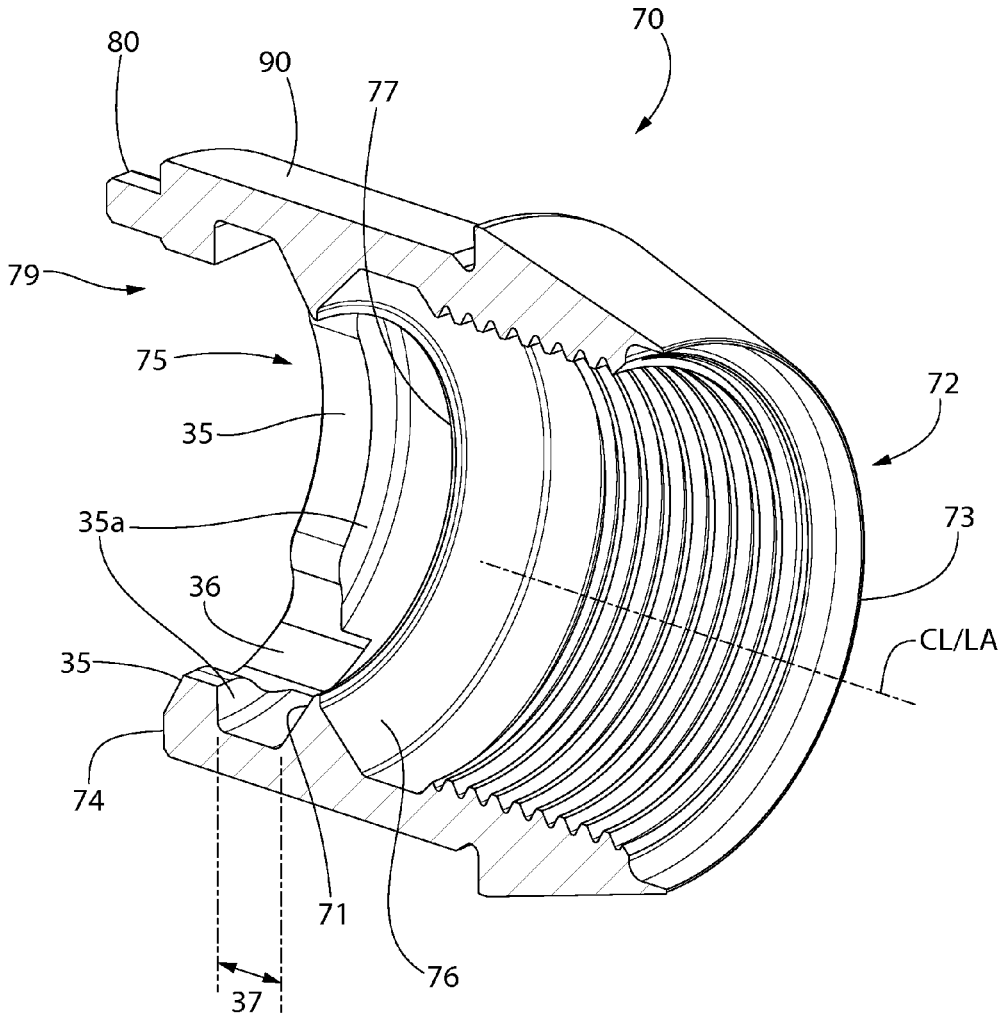
FIG. 13 is a front cross-sectional perspective view thereof.

The action of the shotgun may be a locked-breech design. Accordingly, in one non-limiting embodiment, the bolt head 52 may include a plurality of radially extending bolt lugs 56*a-d* (see, e.g. FIGS. 6A-C) which are cooperatively configured to engage corresponding bolt locking lugs 35 disposed on the rear end of the barrel extension 70 proximate to the barrel chamber 34, as further described herein. Bolt locking lugs 35 project radially inwards from the interior of barrel extension. Any suitable number of bolt lugs 56*a-d* may be provided. In the non-limiting design depicted herein, there may be four bolt lugs 56*a-d* equally positioned around the outside circumference of the bolt head that will slide inside the barrel extension 70 and rotate to engage the forward facing lockup surfaces 35*a* on the bolt locking lugs 35 of the barrel extension 70 to form a closed breech (see also FIG. 13). The bolt lugs 56*a-d* may be arranged such that there is a single bolt lug in each of four quadrants defined by a Cartesian coordinate system having X and Y reference axes as shown in FIGS. 6A and 6C. In other possible embodiments, more or less bolt lugs however may be provided than four.

Referring to FIG. 15, a recoil inertia spring 64 is provided which is disposed within the axial passage 61 inside the slide 60 and generally positioned behind the stem 53 of the bolt. The spring acts on the rear end of the stem to bias the bolt 50 in an axially forward direction (towards the barrel) into the projected position, thereby forming the gap between the mutual blocking surfaces 55, 63 on the bolt head and slide respectively. During firing of the shotgun, the inertia spring 64 is compressed by the bolt 50 thereby substantially eliminating the gap and then driving the slide 60 rearward as the spring subsequently expands during cycling of the action as described herein.

The bolt and slide assembly is shown in FIG. 15 in exploded view. The bolt 50 further includes a curved elongated control slot 57 in the stem 53 which cooperates with a vertical bolt pin 65 mounted in the slide 60 to control the movement of the bolt. The pin 65 limits the axial motion of the bolt. Via interaction between pin 65 and curved camming surfaces 58 formed within the sidewalls of the control slot 57, the bolt 50 is caused to rotate in moving forward and rearward with respect to the slide 60 during the reciprocating recoil motion of the slide and bolt. This motion locks and unlocks the bolt lugs 56*a-d* from the bolt locking lugs 35 to lock and unlock the breech respectively. The bolt assembly further includes a firing pin spring 27*a* which biases the firing pin 27 rearward with respect to the bolt. An operating handle 66 may be provided to manually cycle the slide and action.

Referring to FIGS. 3-4 and 14-15, an extractor 67 is pivotably mounted to the bolt head 52 via a transverse pin 68 which passes through a mounting hole formed in the ejector. The bolt head may have an axial slot 59 which at least partially receives the extractor therein. Spring 69 biases the rear end of the extractor outwards and front hooked end of the extractor inwards to engage the rim of a chamber cartridge when the breech or action is closed (i.e. bolt in battery with the barrel chamber inside the barrel extension 70).

The action of the shotgun 20 is configured for firing light or heavy shell loads. Shotgun shells 22 are generally comprised of metal shot and gunpowder packed inside a hollow cylindrical non-metal hull or case 23 secured to a metal head (base), identified in FIG. 3. The hull typically has a crimped closed front end and contains shot. Shot is generally comprised of a plurality of round metal pellets (e.g. lead or steel) which are offered in various diameters typically dictated by the type of activity (e.g. clay target shooting or game hunting) and size of the game, among other factors.

The head of the shell or cartridge includes a protruding annular peripheral rear rim 24 (e.g. flange) that projects radially outwards beyond the head and contains a primer which is struck by the firing pin and detonated to ignite the gunpowder charge for firing the shotgun. The rim therefore has a larger diameter than the diameter of the shell head and hull or case.

For rimmed cartridges (e.g. shotgun shells, rimfire cartridges, and some centerfire cartridges) fired in known standard firearm designs, the annular forward facing abutment surface on the rim abuttingly engages a rearward facing rim seating surface formed on the rear end of the barrel at the entrance to the chamber when the shell is chambered. When the breech is closed and the bolt is in battery with the barrel chamber, the front breech face of the bolt abuttingly contacts the rim and rear surface of the shell to support the head for withstanding the combustion forces and pressures generated by firing the firearm.

According to embodiments of the present invention, however, the rim seating surface is advantageously formed on the barrel extension instead of on the rear end of the barrel. This advantageously allows the user to only replace the barrel extension in lieu of the entire barrel if the headspacing between the rim seating surface and bolt breech face (when the breech is closed) should become out of tolerance over time due to wear or other factors.

FIGS. 3-14 show the barrel extension 70, barrel 30, and bolt 50 in greater and/or various details. The barrel extension 70 includes a tubular or hollow cylindrical body including a rear locking portion 79 configured for engaging the bolt 50 and a front mounting portion 72 configured for detachable coupling to the rear breech end 32 of the barrel 30. In one embodiment, the mounting portion 72 of the barrel extension may include internal threads configured to engage mating external threads on the barrel 30 for a non-permanent type of mount which is preferred. The barrel extension may therefore be readily threaded on or off of the barrel with minimal effort allowing for rapid replacement. Other non-permanent and less preferred but still suitable permanent mechanical coupling methods may be used including without limitation a pinned or set screw socket arrangement, welded connection, shrink or interference fit, etc. Permanent type mounts may still benefit from the benefits of a barrel extension with integral rim seating surface which allows the bolt locking lugs and other features to be readily fabricated as part of a separate barrel extension in lieu of the barrel itself which may be more complex and costly in some designs. In addition, the barrel extension is shorter than the barrel itself providing more ready access to its interior from either end for machining various features. Furthermore, incorporating the shell rim seating surface 71 and barrel locking lugs 35 which define the headspace in a single component reduces the tolerance stack even for permanently mounted barrel extensions.

With continuing primary general reference to FIGS. 3-14, and more specifically FIGS. 7-14 showing the barrel extension 70 in greater detail, the axially and circumferentially extending opposing sidewalls 90 of the barrel extension may be straight and entirely parallel from the front to rear ends of the barrel extension in some embodiments. In the present illustrated embodiment, the sidewalls 90 of the rear locking portion 79 may be parallel and sidewalls in the front mounting portion 72 may be frustoconical in shape which narrow towards the front of the barrel extension. This arrangement may reduce the overall outer diameter of the mating portions of the barrel and mounting portion of the barrel extension.

The barrel extension 70 further includes an open front end 73 which communicates with the chamber, an open rear end 74 for inserting shells therethrough, and an axial cavity 75 which extends longitudinally inside the barrel extension between the front and rear ends. Barrel extension 70 has an axial centerline CL (see, e.g. FIG. 13) which concentrically aligned with the barrel 30 and longitudinal axis LA when the barrel extension is mounted on the barrel. Several locking and mounting features are disposed in the cavity for engagement with the bolt and barrel, which will now be further described.

Figure 4:
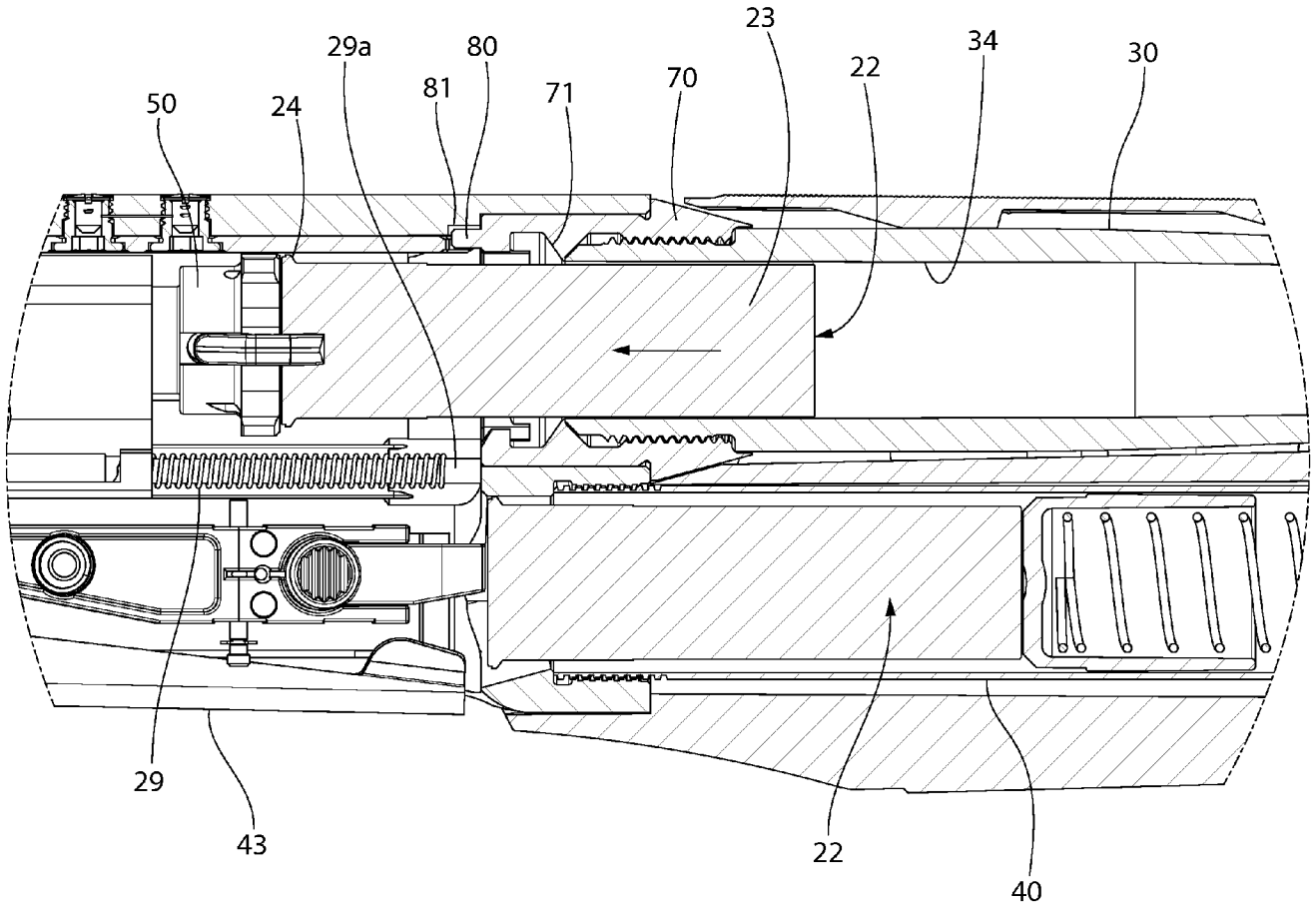
FIG. 4 is a view thereof instead showing a partially open breech with the shell partially extracted from the chamber.
Figure 5:
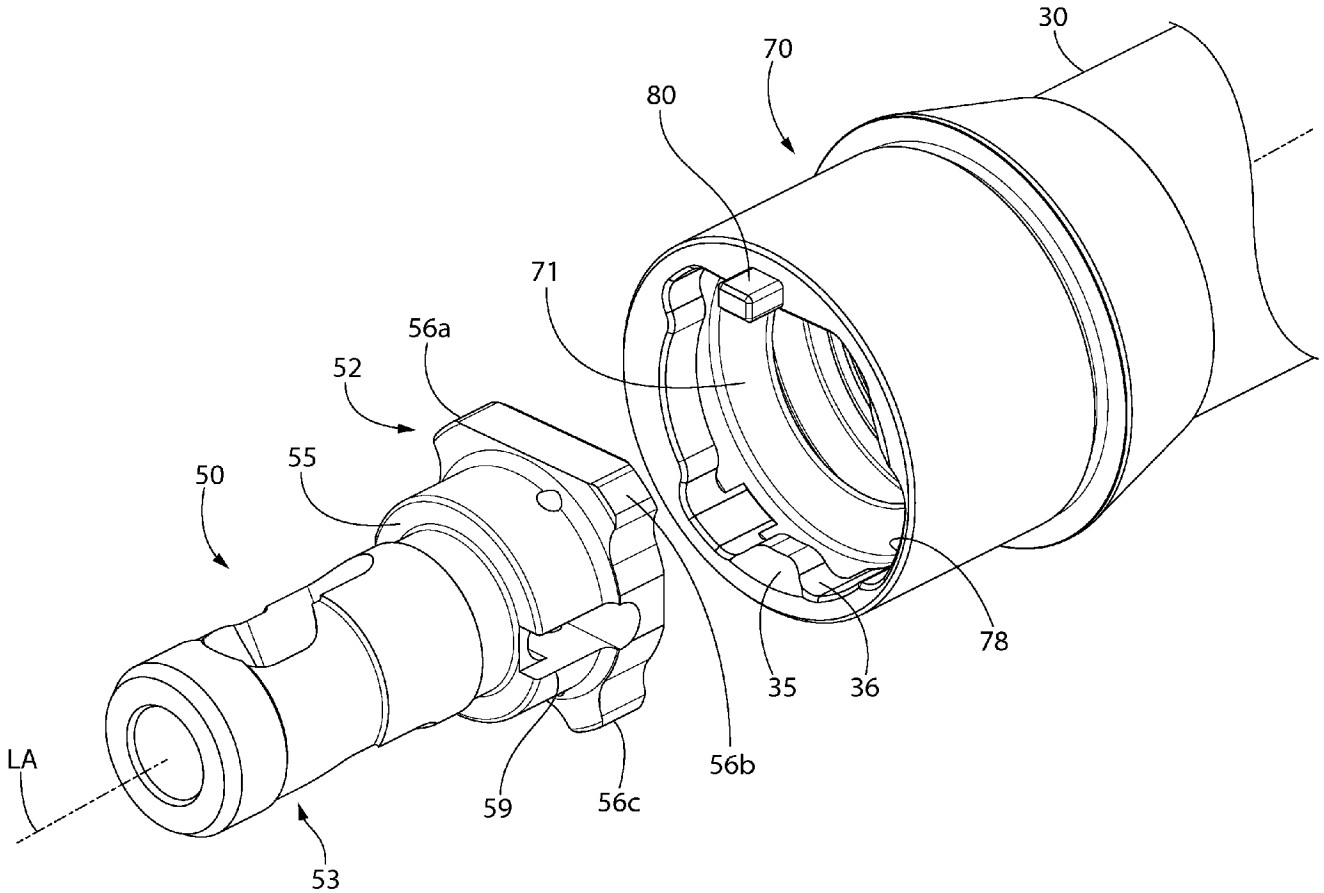
FIG. 5 is an exploded perspective view of the bolt and barrel-barrel extension assembly.
Figure 14:
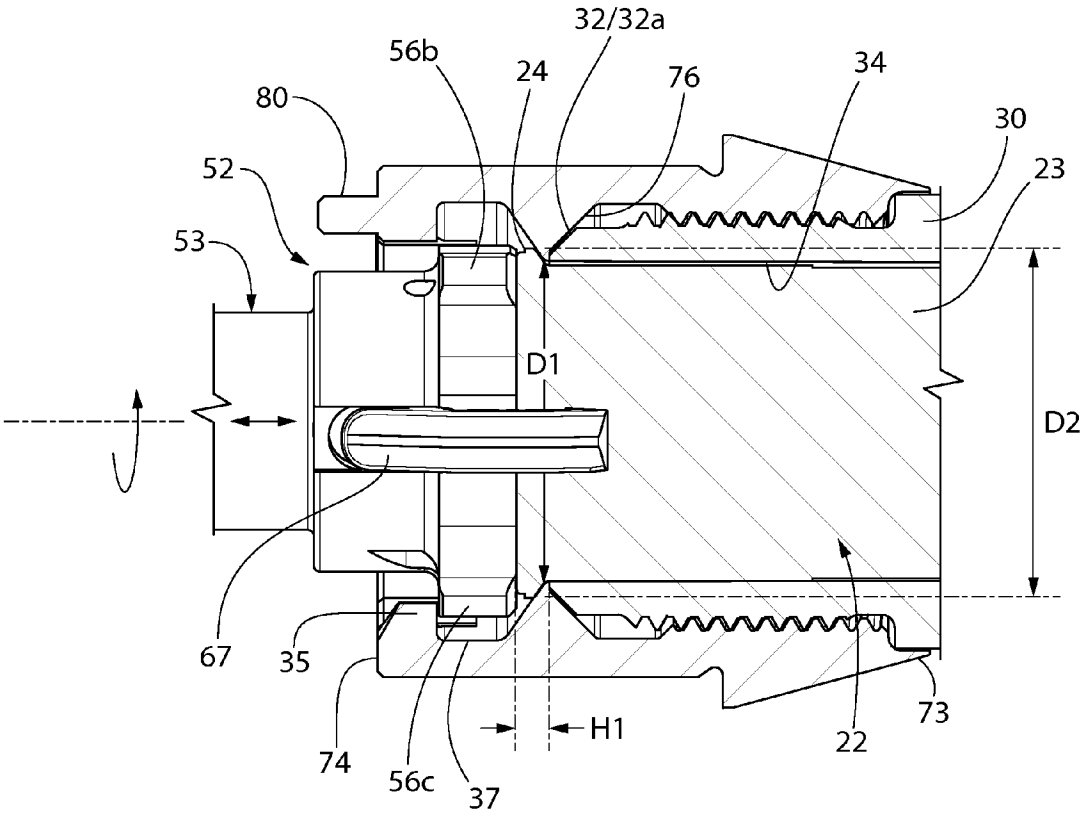
FIG. 14 is a right side cross-sectional view of the barrel extension with fully chambered shell and bolt head in a closed breech position in battery with the rear head of the shell.

The mounting portion 72 of barrel extension includes a forward facing annular barrel seating surface 76 positioned inside the cavity 75 which is configured and arranged to engage the mating rear annular end surface 32*a* defined by the rear breech end 32 of the barrel that circumscribes the chamber 34 entrance, as best shown in FIGS. 3-4 and 14. The rear end 32 of the barrel is inserted through the open front end 73 of the barrel extension. In one embodiment, the barrel seating surface 76 and the barrel rear annular end surface 32*a* may each be obliquely angled with respect to the longitudinal axis LA between 0 and 90 degrees. The angles are complementary such that the mating angled surfaces form substantially flat abutting contact with each other as shown (see also FIGS. 3-4 and 14). The angled surfaces 76, 32*a* contribute to secure engagement between the barrel extension 70 and barrel 30 as the threaded connection is tightened via producing a wedging action. In other possible embodiments, however, the mating surfaces may each be vertical and oriented perpendicular to the longitudinal axis.

Figure 7:
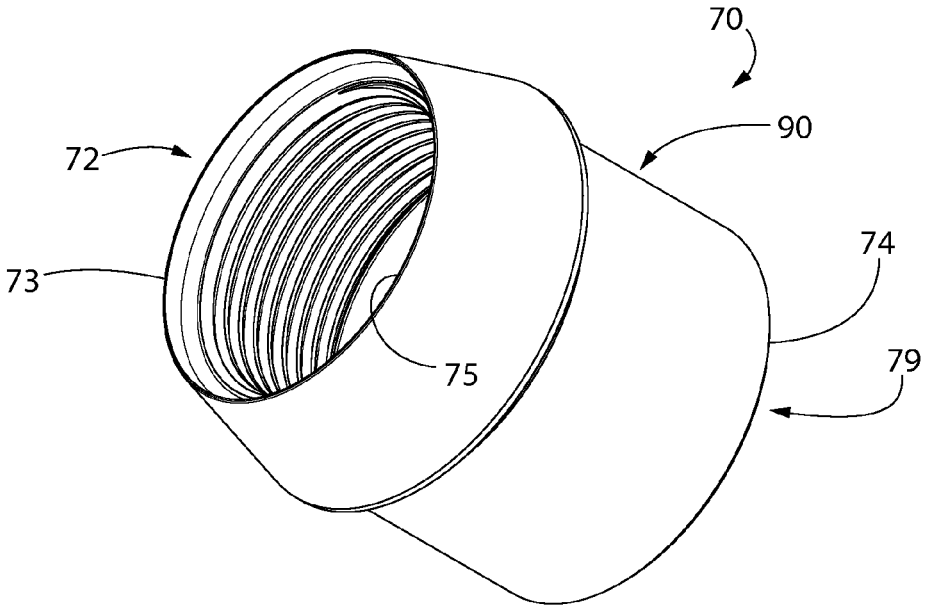
FIGS. 7 and 8 are front and rear perspective views of the barrel extension.
Figure 8:
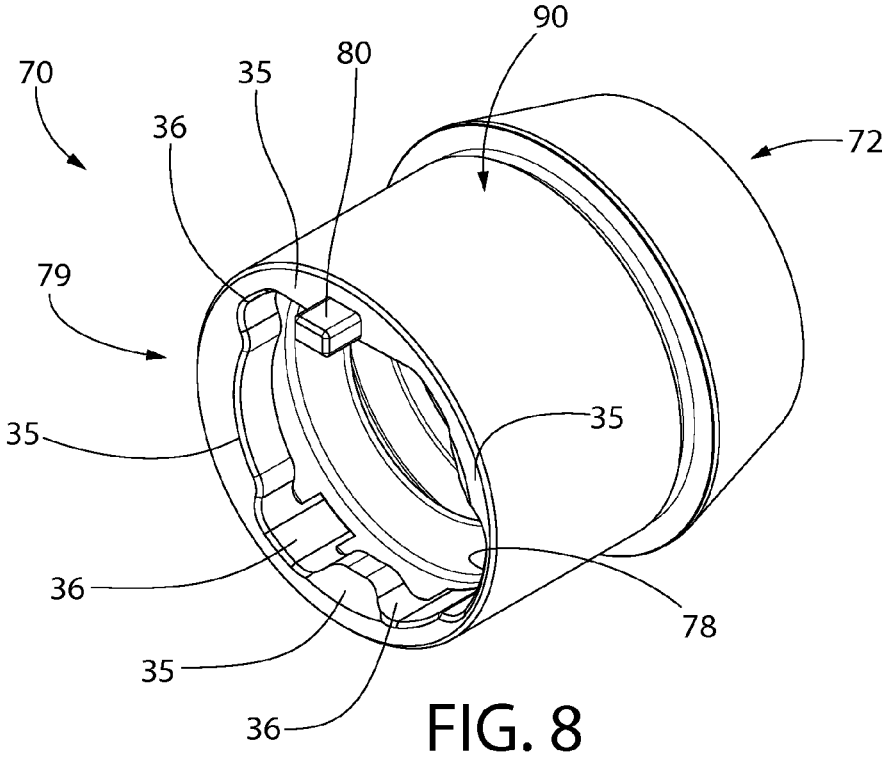
Figure 9:
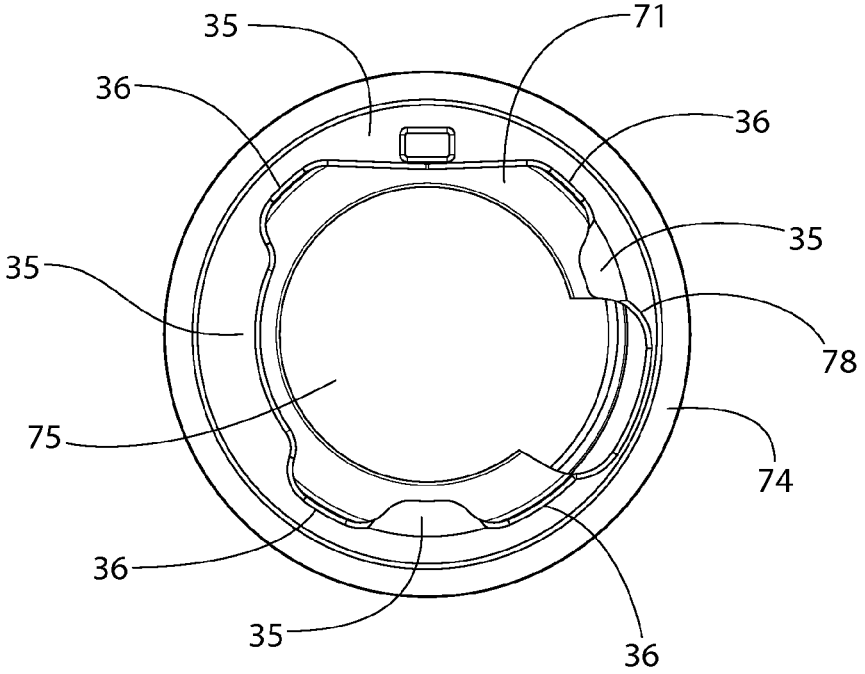
FIGS. 9 and 10 are rear and front end views thereof.
Figure 10:
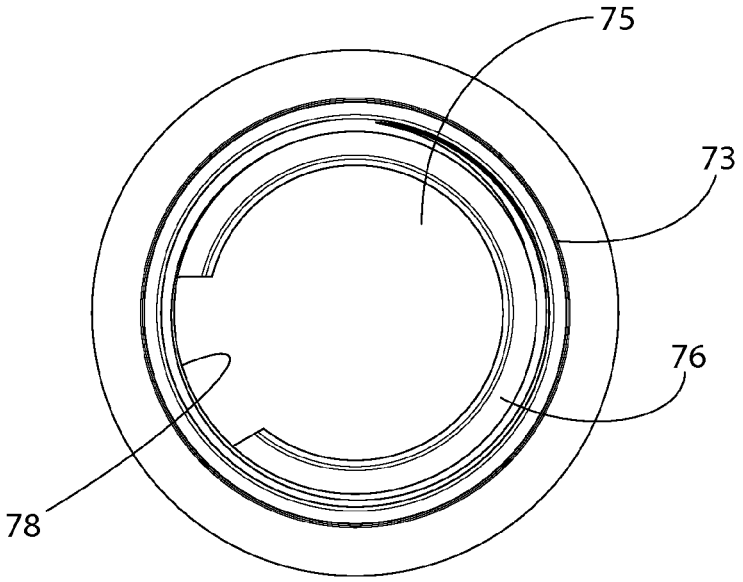
Figure 11:
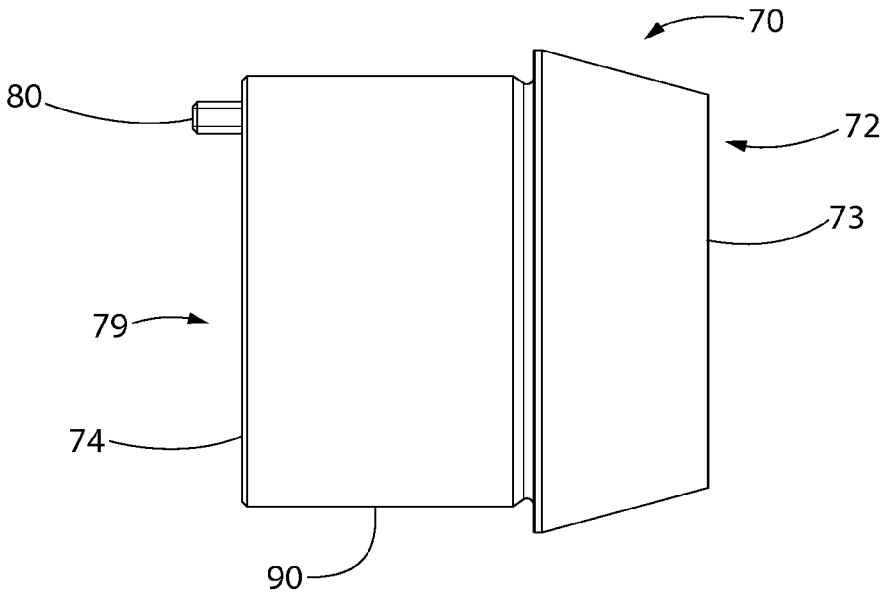
FIGS. 11 and 12 are right side and top plan views thereof.
Figure 12:
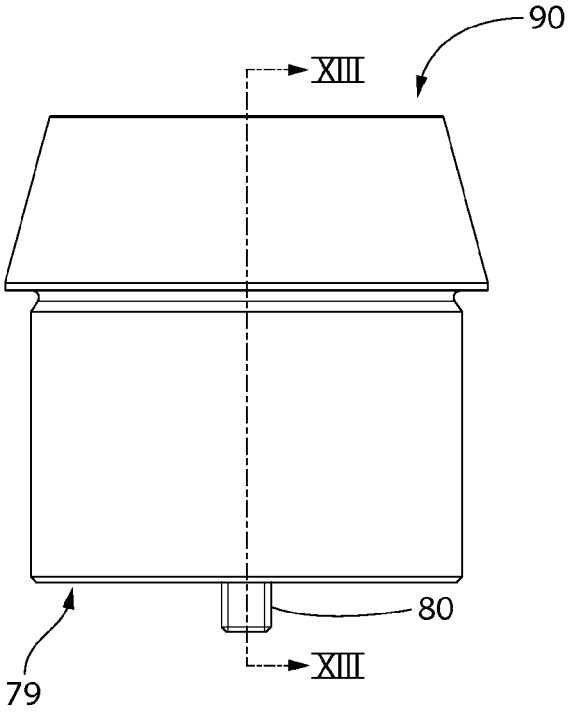

Referring to FIGS. 3-4 and 7-14, the barrel extension 70 further includes a rearward facing rim seating surface 71 inside the cavity 75 which is configured and arranged to engage the rim 24 of the shell 22. When the shell is loaded and inserted into the chamber 34, the rim seating surface engages the forward facing annular abutment surface defined by the rim. This engagement sets the insertion length of the shell into the chamber and thus headspace H1 defined by rim of the shell. In one embodiment, the rim seating surface 71 may be obliquely angled between 0 and 90 degrees in relation to the longitudinal axis LA. In the embodiment shown, the rim seating surface 71 and barrel seating surface 76 may conveniently be formed on opposing sides of a single circumferentially extending annular protrusion 77 which projects transversely inwards from the sidewalls of the barrel extension towards the longitudinal axis. The apex of the protrusion 77 formed between the intersecting angled rim and barrel seating surfaces 71, 76 defines a diameter D1 at the entrance to the chamber 34 which is preferably less than the outside diameter D2 of the shell rim as best illustrated in FIG. 7. This acts a limit stop for fixing the position of the shell 22 and insertion length or depth into the chamber 34 via engagement with the rim 24. Diameter D1 may be substantially coextensive with the inside diameter of the barrel bore within the chamber 34.

Referring to FIGS. 3-7, and as described above, the locking portion 79 of barrel extension 70 includes a circumferential groove 37 and plurality of barrel locking lugs 35 at the rear end 71 of the barrel extension. The barrel locking lugs 35 define forward facing lockup surface 35*a* configured and arranged to engage the rear surface of the bolt lugs 56*a-d* on the head 52 of the bolt 50 to form a closed locked breech. The bolt head is rotatable with respect to bolt slide 60 and the barrel extension 70 to accomplish this lockup. An axial entranceway or channel 36 is formed between the bolt locking lugs to enable the bolt lugs 56*a-d* to enter the circumferential groove. The channels 36 are configured and dimensioned to allow the bolt lugs to be axially and slideably inserted into the barrel extension 70 and enter the circumferential groove 37 formed between the locking lugs 35 and the rear facing annular rim seating surface 71 of the barrel extension 70 (see, e.g. FIGS. 3-5 and 13-14).

In operation after a shell 22 is loaded into the barrel chamber 34 (either manually or via the bolt 50 and slide 60 moving forward from a magazine), the bolt is axially slid forward with the bolt lugs 56*a-d* each aligned with an axial channel 36 on the barrel extension between the bolt locking lugs. The bolt lugs enter the rear locking portion 79 of the barrel extension 70 and are inserted into the circumferential groove 37 therein, after which the bolt is rotated to engage the bolt lugs with the lockup surfaces 35*a* of the bolt locking lugs 35 to form a closed locked breech (see, e.g. FIGS. 3 and 7). With the appropriate headspace H1 provided, the front breech face 51 of the bolt 50 preferably abuttingly engages the head and rim 24 of the shell 22 to provide support during discharge of the shotgun 20.

Under recoil from firing the shotgun or when manually opening the breech via the slide operating handle 66 to move the slide 60 rearward, the bolt head 52 is automatically rotated via the control slot 58 and control pin 65 to disengage the bolt locking lugs 35 from the bolt lugs 56*a-d* and axially align each bolt lug with a corresponding channel 36 in the barrel extension 70. The bolt head 52 may now be axially withdrawn rearward from the barrel extension via either automatic operation of the bolt slide or manually.

In some embodiments, the rear annular surface at the rear end 74 of the barrel extension 70 may be interrupted by an axial extractor slot 78 allowing the hooked front end of the extractor 67 to enter and grasp the rim 24 of the shell when the breech is closed for removing a spent casing from the chamber 34 (see, e.g. FIGS. 3-4 and 14). FIG. 3 shows a closed breech and FIG. 4 shows a partially open breech. The extractor slot 78 has a sufficient height to allow the bolt head with extractor 67 attached thereto to rotate between the locked and unlocked breech positions when the breech is closed.

In one embodiment, the barrel extension 70 includes a cantilevered anti-rotation pin 80 which projects rearwardly from the rear end of 74 of the barrel extension. The pin 80 enters and engages a corresponding forwardly open socket 81 disposed in the receiver 21 to properly orient the barrel extension 70 with respect to the receiver.

While the foregoing description and drawings represent exemplary embodiments of the present disclosure, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes described herein may be made within the scope of the present disclosure. One skilled in the art will further appreciate that the embodiments may be used with many modifications of structure, arrangement, proportions, sizes, materials, and components and otherwise, used in the practice of the disclosure, which are particularly adapted to specific environments and operative requirements without departing from the principles described herein. The presently disclosed embodiments are therefore to be considered in all respects as illustrative and not restrictive. The appended claims should be construed broadly, to include other variants and embodiments of the disclosure, which may be made by those skilled in the art without departing from the scope and range of equivalents.

What is claimed is:

1. A firearm with barrel extension comprising:

a longitudinal axis;

a receiver;

a barrel supported by the receiver and including a front muzzle end, a rear breech end defining a chamber for holding an ammunition shell, and an axial bore extending between the ends;

a bolt supported by the receiver for axial forward and rearward movement, the bolt comprising a bolt head including a plurality of bolt lugs extending radially outward from the bolt and rotatable between locked and unlocked breech positions;

a tubular barrel extension having a front end coupled to the rear breech end of the barrel and a rear end defining a plurality of bolt locking lugs that rotatably engage the bolt lugs when the bolt is in the locked breech position; and a rear facing annular rim seating surface formed integrally on the barrel extension as a unitary structural part thereof, the rim seating surface extending radially inwards from an interior surface of the barrel extension and arranged to engage a rim of a shell when positioned in the chamber;

wherein the rim seating surface is disposed inside an axial cavity formed in the barrel extension between the front and rear ends;

wherein the barrel extension includes an inwardly radially extending annular protrusion in the axial cavity of the barrel extension that defines the rear facing annular rim seating surface on a first side of the annular protrusion and a front facing annular mounting surface on a second side of the annular protrusion that engages a mating rear facing annular surface formed on the breach end of the barrel; and wherein the rim seating surface of the barrel extension is circumferentially continuous except for an axially extending extractor slot formed in the seating surface that receives a hooked front end of an extractor that engages the rim of the shell for extracting the shell from the chamber.

2. The firearm according to claim 1, wherein the barrel extension is detachably mounted on the rear breech end of the barrel.

3. The firearm according to claim 1, wherein the front end of the barrel extension includes an internally threaded portion that rotatably engages an externally threaded portion of the barrel.

4. The firearm according to claim 1, wherein the rim seating surface is obliquely angled to longitudinal axis.

5. The firearm according to claim 4, wherein the mounting surface on the annular protrusion and the rear facing annular surface on the breach end of the barrel are each obliquely angled with respect to the longitudinal axis and configured to form a flat-to-flat surface engagement when the barrel extension is mounted on the barrel.

6. The firearm according to claim 1, wherein the rear facing annular surface on the breach end of the barrel is circumferentially continuous and uninterrupted for a full 360 degree extent.

7. The firearm according to claim 1, wherein the extractor slot further penetrates the rear end of the barrel extension.

8. The firearm according to claim 1, wherein an axial distance between the rim seating surface and a front breach surface of the bolt head define a headspace.

9. The firearm according to claim 1, further comprising a circumferential groove disposed inside the barrel extension between the annular rim seating surface and the barrel locking lugs that receives the bolt lugs, the bolt lugs being rotatable within the groove for rotating the bolt between the unlocked and locked breech positions.

10. The firearm according to claim 1, wherein the rim of the shell when positioned in the chamber engages the annular rim seating surface but not an annular rear-facing surface of the breech end of the barrel.

11. A firearm with barrel extension comprising:

a receiver;

a barrel supported by the receiver and including a front muzzle end, a rear breech end defining a chamber configured to hold an ammunition shell, and an axial bore extending between the ends that defines a longitudinal axis;

a slide movably disposed in the receiver for axial forward and rearward movement;

a bolt supported by the slide and axially movable forward and rearward with the slide, the bolt comprising a bolt head including a plurality of bolt lugs extending radially outward from the bolt and rotatable between locked and unlocked breech positions;

a tubular barrel extension having a front mounting portion coupled to the rear breech end of the barrel and a rear locking portion defining a plurality of bolt locking lugs that rotatably engage the bolt lugs when the bolt is in the locked breech position; and a rear facing annular rim seating surface formed integrally on the barrel extension as a unitary structural part thereof, the rim seating surface disposed inside an axial cavity formed in the barrel extension between the front and rear portions, and extending radially inwards from an interior surface of the barrel extension;

wherein the barrel extension includes an inwardly radially extending annular protrusion in the axial cavity of the barrel extension that defines the rear facing annular rim seating surface on a first side of the annular protrusion and a front facing annular mounting surface on a second side of the annular protrusion that engages a mating rear facing annular surface formed on the breach end of the barrel;

wherein the rim seating surface of the barrel extension is circumferentially continuous except for an axially extending extractor slot formed in the seating surface that receives a hooked front end of an extractor that engages the rim of the shell for extracting the shell from the chamber;

wherein when a shell having a case and a rear rim is loaded in the chamber in a forward-most position, the case engages the chamber in the barrel and rim engages the rim seating surface of the barrel extension.

12. The firearm according to claim 11, wherein the rim seating surface is obliquely angled to longitudinal axis.

13. The firearm according to claim 12, wherein the mounting surface is obliquely angled to the longitudinal axis.

14. A barrel extension for a firearm with lockable breech, the barrel extension comprising:

a tubular body including an axial centerline, a front mounting portion configured for coupling to a rear breech end of a firearm barrel, and a rear locking portion, the barrel extension including circumferential sidewalls extending longitudinally between the mounting and locking portions that defines an internal axial cavity;

a plurality of inwardly extending radial bolt locking lugs in the rear locking portion;

a plurality of axial channels disposed between the bolt locking lugs which extend forward from a rear end of the barrel extension into a circumferential groove located in front of the bolt locking lugs, wherein the bolt locking lugs are configured to rotatably engage radial bolt lugs of a lockable bolt of the firearm when the bolt lugs positioned in the circumferential groove and rotated; and a rear facing annular rim seating surface formed integrally on the barrel extension as a unitary structural part thereof and between the front and rear portions, the rim seating surface extending radially inwards from the sidewalls in the axial cavity and positioned to engage a radially protruding rim of an ammunition shell when inserted into the barrel extension from the rear end;

wherein the barrel extension includes an inwardly radially extending annular protrusion in the axial cavity of the barrel extension that defines the rear facing annular rim seating surface on a first side of the annular protrusion and a front facing annular mounting surface on a second side of the annular protrusion that engages a mating rear facing annular surface formed on the breach end of the barrel; and wherein the rim seating surface of the barrel extension is circumferentially continuous except for an axially extending extractor slot formed in the seating surface that receives a hooked front end of an extractor that engages the rim of the shell for extracting the shell from the chamber.

15. The barrel extension of claim 14, wherein the rim seating surface is obliquely angled with respect to the axial centerline of the body.

16. The barrel extension of claim 15, wherein the sidewalls in the front mounting portion have a frustoconical shape and sidewalls in the rear locking portion are parallel to the axial centerline of the body.

* * * * *